US007911122B2

(12) United States Patent
Behr et al.

(10) Patent No.: US 7,911,122 B2
(45) Date of Patent: Mar. 22, 2011

(54) LAMP BASE WITH A CUTOUT AND LAMP WITH CORRESPONDING LAMP BASE

(75) Inventors: Gerhard Behr, Altheim (DE); Peter Helbig, Sontheim/Brenz (DE)

(73) Assignee: Osram Gesellschaft mit Beschraenkter Haftung, Munich (DE)

( * ) Notice: Subject to any disclaimer, the term of this patent is extended or adjusted under 35 U.S.C. 154(b) by 185 days.

(21) Appl. No.: 12/223,959

(22) PCT Filed: Feb. 19, 2007

(86) PCT No.: PCT/EP2007/051552

§ 371 (c)(1),
(2), (4) Date: Aug. 14, 2008

(87) PCT Pub. No.: WO2007/096325

PCT Pub. Date: Aug. 30, 2007

(65) Prior Publication Data

US 2009/0009049 A1 Jan. 8, 2009

(30) Foreign Application Priority Data

Feb. 21, 2006 (DE) ..... 20 2006 002 888 U

(51) Int. Cl.
*H01K 5/48* (2006.01)

(52) U.S. Cl. ..... 313/318.06; 313/318.05; 439/611; 362/549

(58) Field of Classification Search ..... 313/318.06, 313/318.05; 439/611; 362/549
See application file for complete search history.

(56) References Cited

U.S. PATENT DOCUMENTS

| | | | | |
|---|---|---|---|---|
| 4,067,634 | A * | 1/1978 | Hoffman | 439/467 |
| 5,211,551 | A | 5/1993 | Uppal et al. | |
| 5,479,066 | A | 12/1995 | Willems et al. | |
| 5,957,569 | A | 9/1999 | Helbig et al. | |
| 6,005,336 | A * | 12/1999 | Helbig et al. | 313/318.01 |
| 6,080,019 | A | 6/2000 | Coushaine | |
| 6,244,737 | B1 | 6/2001 | Rittner et al. | |
| 6,254,252 | B1 * | 7/2001 | Coushaine et al. | 362/549 |
| 6,270,235 | B1 * | 8/2001 | Coushaine | 362/645 |

(Continued)

FOREIGN PATENT DOCUMENTS

DE 85 22 794 U1 5/1986

(Continued)

OTHER PUBLICATIONS

German translation of Japanese Office Action issued Aug. 4, 2010.

*Primary Examiner* — Peter Macchiarolo

(57) ABSTRACT

The invention relates to a lamp base with a plastic base part which has electrical connections for the power supply of at least one lighting device of the lamp, the lighting device being enclosed by a lamp vessel and the electrical connections being configured by metal pins. The first ends of these pins project laterally, perpendicular to the longitudinal extension of the lamp base, from the plastic base part in order to establish electrical contact with the lamp socket, and the second ends are adapted to connect a power supply wire for the at least one lighting device which wire is to the outside of the lamp vessel. The invention is characterized in that the plastic base part has a recess on a lower face of the plastic base part facing away from the lamp vessel, the two ends of the metal pins being disposed in the recess.

4 Claims, 4 Drawing Sheets

U.S. PATENT DOCUMENTS

Figure 1:
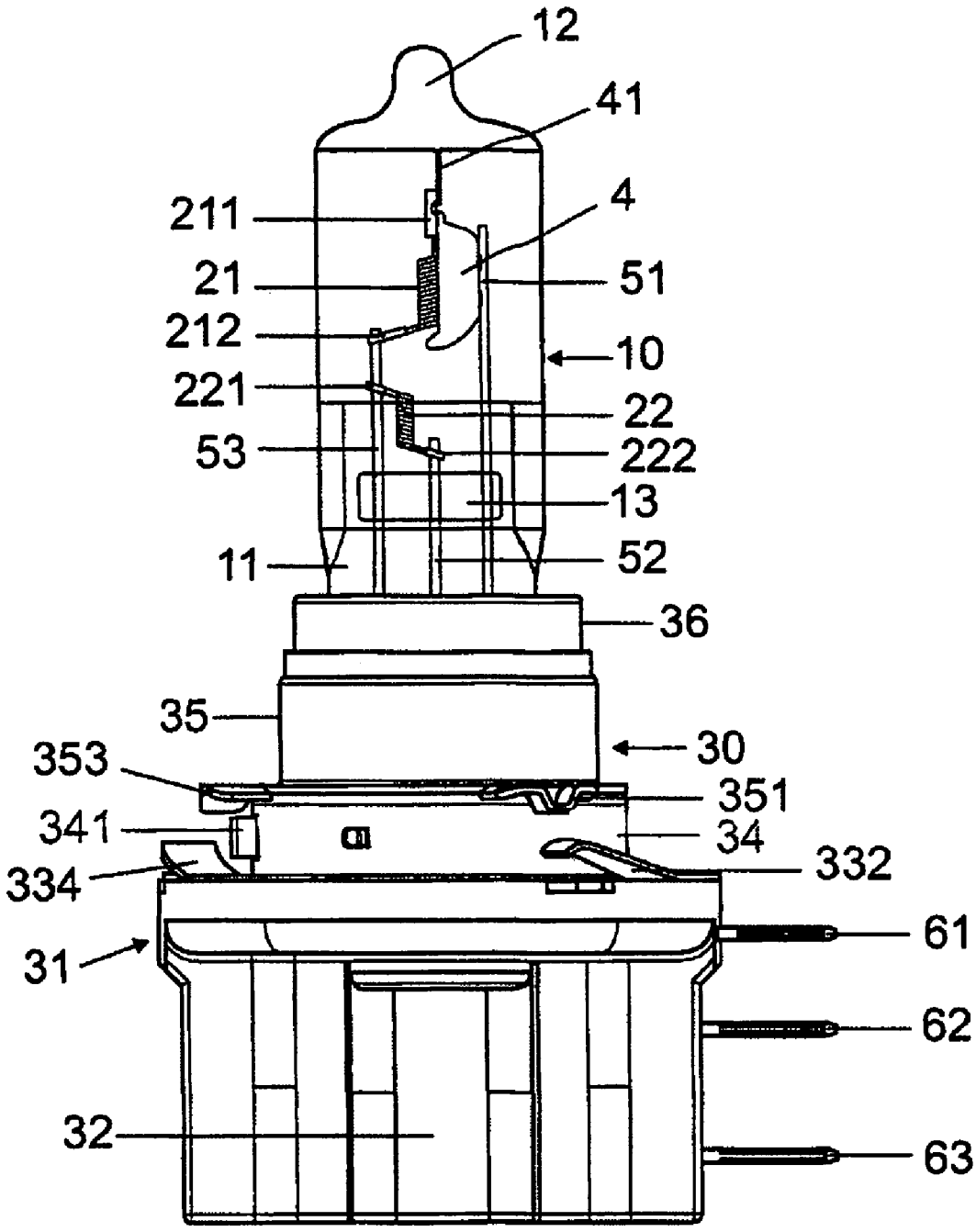

| | | | | |
|---|---|---|---|---|
| 6,328,455 | B1 * | 12/2001 | Helbig | 362/657 |
| 6,710,526 | B1 | 3/2004 | Helbig | |
| 6,981,793 | B2 | 1/2006 | Behr et al. | |
| 7,083,476 | B2 * | 8/2006 | Helbig et al. | 439/699.2 |
| 7,097,343 | B2 | 8/2006 | Tiesler-Wittig et al. | |
| 7,112,917 | B2 * | 9/2006 | Behr et al. | 313/318.01 |
| 7,417,364 | B2 * | 8/2008 | Wegman et al. | 313/318.01 |
| 2006/0285349 | A1 * | 12/2006 | Helbig et al. | 362/549 |
| 2008/0150448 | A1 * | 6/2008 | Lerchegger et al. | 315/276 |
| 2009/0257236 | A1 * | 10/2009 | Behr et al. | 362/414 |
| 2010/0060160 | A1 * | 3/2010 | Auer et al. | 313/569 |
| 2010/0090598 | A1 * | 4/2010 | Auer et al. | 313/579 |

FOREIGN PATENT DOCUMENTS

| | | | |
|---|---|---|---|
| EP | 1 006 551 | B1 | 6/2000 |
| JP | 6-193549 | | 7/1994 |
| JP | 6-302303 | | 10/1994 |
| JP | 10-510675 | | 10/1998 |
| JP | 11-502365 | | 2/1999 |
| JP | 2003-513413 | A | 4/2003 |
| JP | 2004-221086 | A | 8/2004 |
| JP | 2005-505113 | A | 2/2005 |
| JP | 2005-513744 | A | 5/2005 |
| JP | 2005-228748 | A | 8/2005 |
| WO | 03030213 | A2 | 4/2003 |
| WO | 03/056237 | A1 | 7/2003 |

* cited by examiner

LAMP BASE WITH A CUTOUT AND LAMP WITH CORRESPONDING LAMP BASE

The invention relates to a lamp base as claimed in the preamble of claim 1.

I. PRIOR ART

The patent specification EP 1 006 551 B1 has disclosed a lamp base of a vehicle headlamp which is in the form of a metal/plastic base and which has electrical terminals in the form of metal webs. In order to weld the power supply wires, which protrude out of the lamp vessel and are used for supplying power to the incandescent filament, to the metal webs, at least one aperture is provided in the lamp base, through which aperture the weld point is accessible for a laser or another suitable welding tool. In addition, the metal webs are equipped with thread-in means in order to be able to join the bent-back ends of the power supply wires to the metal webs.

II. DESCRIPTION OF THE INVENTION

The object of the invention is to provide a lamp base of the generic type in which the ends of power supply wires and electrical terminals which are to be connected to one another have improved accessibility during the connection process.

This object is achieved according to the invention by the features of claim 1. Particularly advantageous embodiments of the invention are described in the dependent claims.

The lamp base according to the invention has a lamp base with a plastic base part, which is provided with electrical terminals for supplying power to at least one luminous means of the lamp which is surrounded by a lamp vessel, the electrical terminals being in the form of metal webs, whose first end protrudes laterally, perpendicular to the longitudinal extent of the lamp base, out of the plastic base part in each case for the purpose of producing the electrical contact with a lampholder, and whose second end is provided in each case for connection to a power supply wire, which is passed out of the lamp vessel, for the at least one luminous means, the plastic base part having, on a lower side, which faces away from the lamp vessel, of the plastic base part, a cutout, in which the second ends of the metal webs are arranged. As a result, the apertures provided in the lamp base in accordance with the prior art for laser welding purposes are no longer required. The connection between the second ends of the metal webs and the power supply wires for the at least one luminous means can be carried out from the lower side of the plastic base part since the second ends of the metal webs are accessible in the cutout on the lower side of the plastic base part.

Advantageously, the plastic base part has funnel-like leadthroughs, which extend as far as its lower side, for the power supply lines of the at least one luminous means in order to make it easier to thread in or lead the abovementioned power supply wires through the plastic base part.

The second ends of the metal webs are advantageously each provided with an aperture or a notch for accommodating a power supply wire in order to simplify the connection to the power supply wire. As a result, the power supply wire can be connected to the corresponding metal web on the lower side, which faces away from the plastic base part, of the second end of the respective metal web.

In accordance with the preferred exemplary embodiment of the invention, the second ends of the metal webs are arranged in a common plane perpendicular to the longitudinal extent of the lamp base in order to obtain a compact design of the lamp base with as low an installation height as possible.

Preferably, the lamp base has a closure element, which is used for covering the cutout on the lower side of the plastic base part. As a result, the connections between the power supply wires and the metal webs are protected against damage and contamination.

The closure element is preferably fixed on the plastic base part by means of a clamping fit in order to ensure a connection between the closure element and the plastic base part which can be produced easily.

In addition, the closure element is preferably in the form of a coding for the lamp, with the result that the user of the lamp can use the closure element to identify which version of the lamp type he has in front of him. In particular, the coding can be implemented by the shape or color of the closure element. For example, lamps of the same type which, however, belong to different interchangeable versions can have differently constructed or colored closure elements in order to be able to distinguish between them more easily. For example, vehicle headlamps which generate light of different color temperatures, such as, for example, the lamp versions going under the trade names OSRAM COOL BLUE and OSRAM LIGHT@DAY, can thereby be distinguished from one another more easily.

In accordance with a preferred exemplary embodiment of the invention, the cutout for the second ends of the metal webs is arranged on the lower side, which is remote from the lamp vessel, of a disk-shaped section of the plastic base part, and the first ends of the metal webs protrude laterally, perpendicular to the longitudinal extent of the lamp base, out of at least one web of the plastic base part, which is integrally formed on the lower side of the disk-shaped section and runs in the direction of the longitudinal extent of the lamp base. Thus, the plastic base part can be in the form of an injection-molded part, in which the metal webs are embedded in such a way that their first ends protrude laterally out of the lamp base and their second ends are accessible via a cutout on the lower side in order to be able to connect them to the power supply wires.

Preferably, the at least one web of the plastic base part is provided with guide means for the closure element, and the closure element is shaped in such a way that it forms, with the at least one web, a grip for inserting the lamp into a lampholder. In particular, the closure element can be shaped in such a way that it enlarges the width of the abovementioned web and thus a grip is formed which makes it easier to insert or screw the lamp into a lampholder.

The lamp base according to the invention is advantageously suitable for a vehicle headlamp.

III. DESCRIPTION OF THE PREFERRED EXEMPLARY EMBODIMENT

Figure 2:
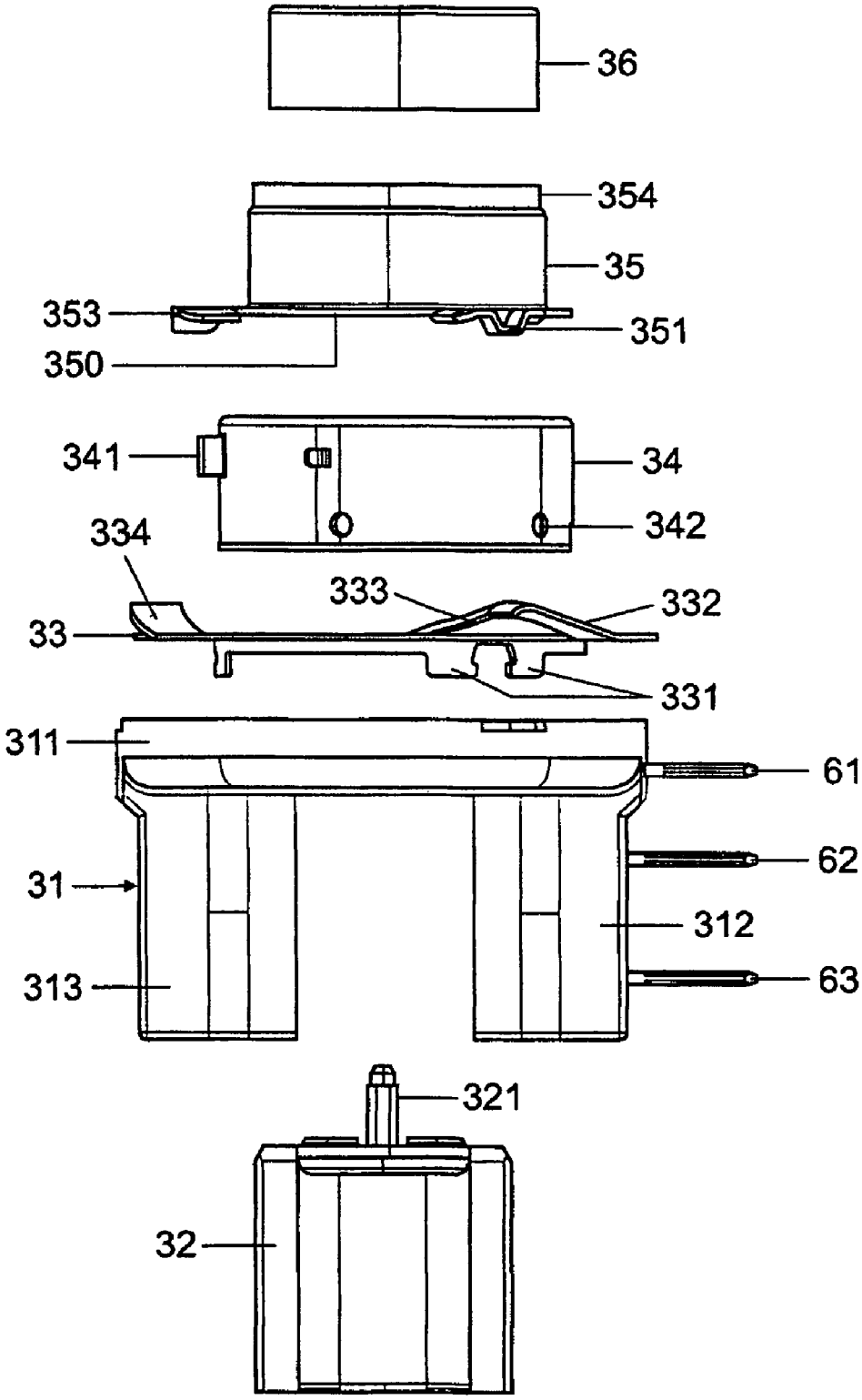
Figure 3:
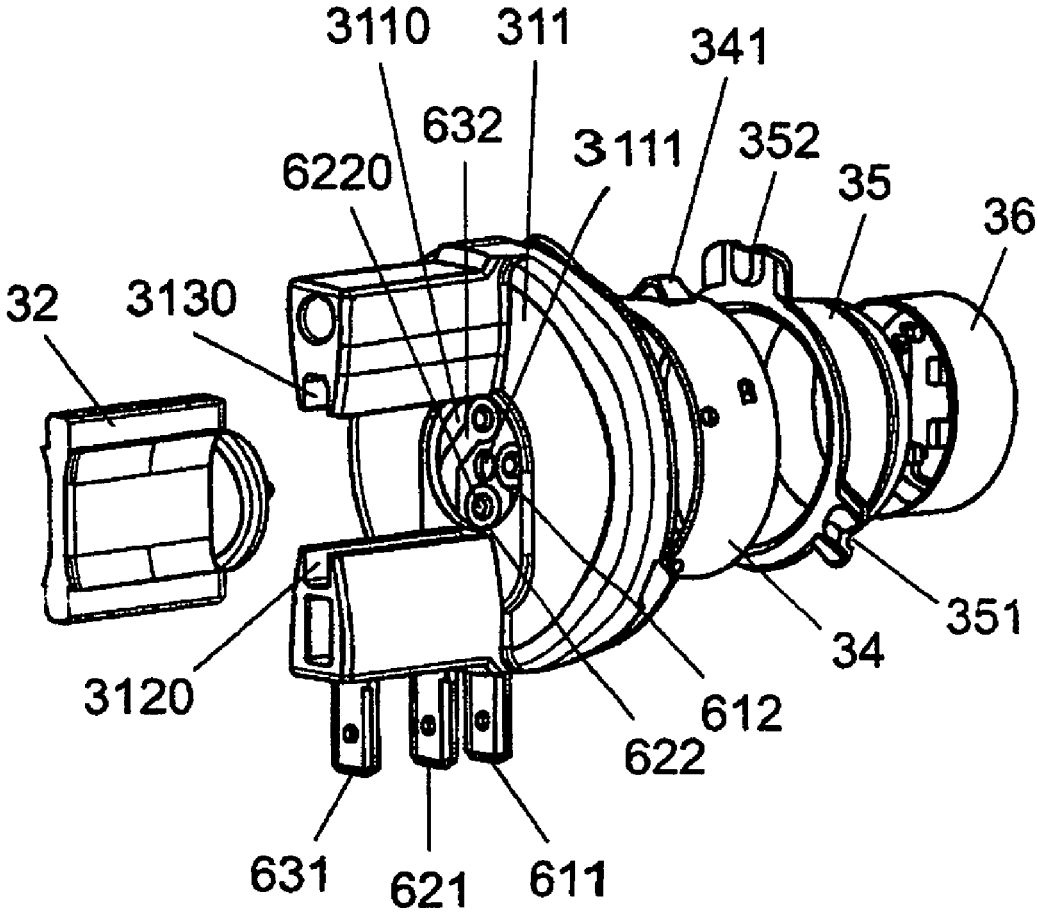
Figure 4:
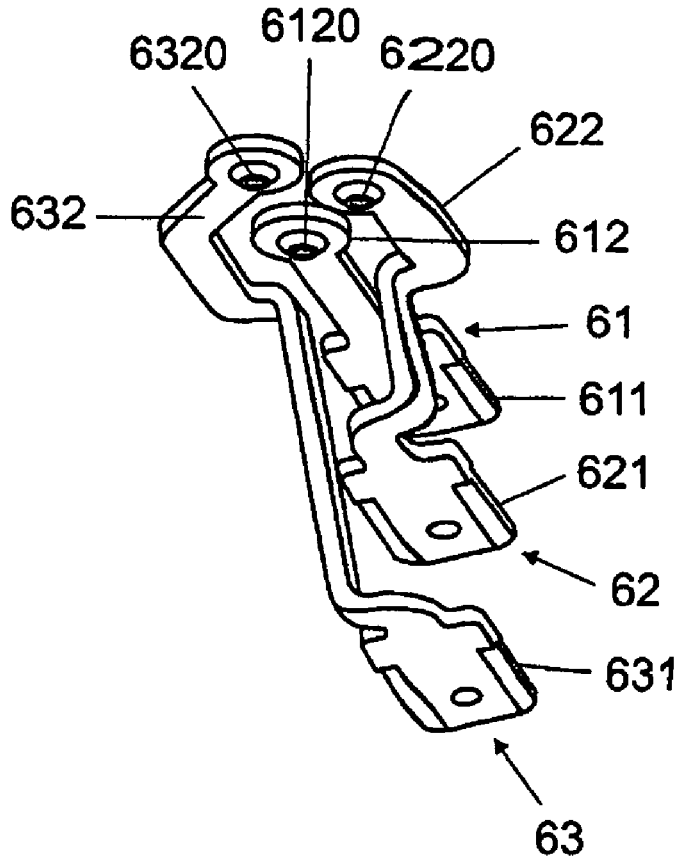
Figure 5:
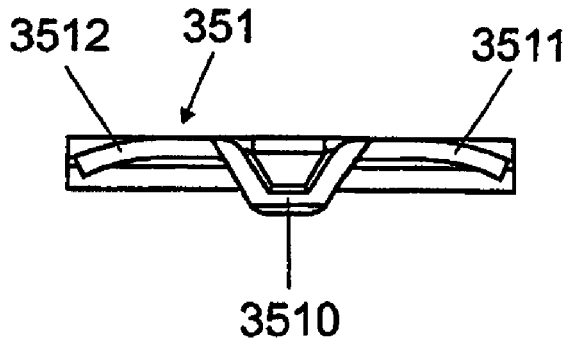

The invention will be explained in more detail below with reference to a preferred exemplary embodiment. In the drawing:

FIG. 1 shows a side view of a vehicle headlamp which is equipped with the lamp base in accordance with the preferred exemplary embodiment of the invention, FIG. 2 shows a side view of the individual components of the lamp base of the lamp depicted in FIG. 1, FIG. 3 shows a plan view of the lower side, which faces away from the lamp vessel, of the lamp base or of the vehicle headlamp depicted in FIG. 1, FIG. 4 shows an illustration of the physical arrangement and design of the contact lugs of the vehicle headlamp depicted in FIG. 1, and FIG. 5 shows a plan view of one of the reference tabs of the lamp base depicted in FIG. 1 or 2.

FIG. 1 illustrates a halogen incandescent lamp for a vehicle headlamp which has been provided with the lamp base according to the invention. This halogen incandescent lamp has a vitreous substantially cylindrical lamp vessel 10, in whose interior are arranged two incandescent filaments 21, 22, which are aligned parallel to the lamp vessel axis and are used, for example, for producing an upper beam and a day-time running light or an upper beam and a lower beam. The incandescent filaments 21, 22 are, for example, in the form of single-coil or double-coil tungsten wires. The outgoing filament ends 211, 212 and 221, 222 of the incandescent filaments 21 and 22, respectively, each have a molybdenum foil wound around them which is used as a welding aid when welding the outgoing filament ends 211, 212 and 221, 222 to the power supply lines for the incandescent filaments 21, 22. A sealed end 11 of the lamp vessel 10 is anchored in a lamp base 30. The lamp vessel dome which faces away from the lamp base 30 is provided with an opaque coating 12. The first incandescent filament 21 is partially surrounded by an anti-dazzle device 4 shaped out of sheet molybdenum. The anti-dazzle device 4 is borne by a first power supply wire 51, which, together with a second power supply wire 52 and a third power supply wire 53, is used for supplying power to the two incandescent filaments 21, 22. For this purpose, a first outgoing filament 211 of the first incandescent filament 21 is welded by means of projection welding to a welding lug 41 of the anti-dazzle device 4 and as a result is electrically conductively connected to the first power supply wire 51 via the anti-dazzle device 4. The second outgoing filament end 212 of the first incandescent filament 21 is welded to the third power supply wire 53. The first outgoing filament end 221 of the second incandescent filament 22 is likewise welded to the third power supply wire 53. The second outgoing filament end 222 of the second incandescent filament 22 is welded to the second power supply wire 52. The three power supply wires 51, 52, 53 each consist of molybdenum and are fixed between two quartz glass webs 13 which are fused with one another, with the result that they are arranged in a common plane. The three power supply wires 51, 52, 53 are passed through the sealed end 11 of the lamp vessel 10 and in each case electrically conductively connected to one of the three metal webs 61, 62 or 63 in the form of contact lugs. The three contact lugs 61, 62, 63 protrude laterally out of the lamp base 30 and form the electrical terminals of the halogen incandescent lamp.

The lamp base 30 has a plastic base part 31 in the form of an injection molded part, in which the contact lugs 61, 62, 63 are embedded. The plastic base part 31 has a section 311 in the form of a circular disk and two mutually opposite webs 312, 313, which are integrally formed on the lower side, which is remote from the lamp vessel 10, of the section 311 and extend parallel to the axis of the section 311 in the form of a circular disk. The three contact lugs 61, 62, 63 each consist of sheet metal and are embedded in the first web 312, with the result that their free ends 611, 621, 631 protrude laterally or radially out of the web 312 of the plastic base part 31 and are arranged one above the other in the direction of the lamp longitudinal axis. The ends 612, 622, 632, which are welded to the power supply wires 51, 52, 53, of the contact lugs 61, 62, 63 are arranged close to the axis of the section 311 in the form of a circular disk, in a cutout 3110 on its lower side, i.e. on that side of the section 311 in the form of a circular disk which is remote from the lamp vessel. Details relating to the contact lugs 61, 62, 63, in particular their design and their physical arrangement, are illustrated schematically in FIG. 4. The ends 612, 622, 632, which are to be welded to the power supply wires 51, 52, 53 of the contact lugs 61, 62, 63 each have an aperture 6120, 6220, 6320, through which the corresponding power supply wire 51, 52 or 53 is passed and, on the lower side, which is remote from the lamp vessel 10, of the contact lugs 61, 62 or 63, is welded to the end 612, 622 or 632 of this contact lug 61, 62, 63. In order that the power supply wires 51, 52, 53 can be threaded without any problems into the aperture 6120, 6220, 6320 of the corresponding contact lug end 612, 622, 632, the disk-shaped section 311 of the plastic base part 31 has funnel-like leadthroughs for the power supply wires 51, 52, 53, which extend from the upper side, which faces the lamp vessel 10, of the section 311 in the form of a circular disk as far as its lower side and are tapered conically in the direction of the lower side and are positioned above the apertures 6120, 6220, 6320. A closure element 32, which likewise consists of plastic and is inserted into the interspace between the two webs 312, 313, and is connected via guiderails 3120, 3130 to the webs 312, 313, closes the abovementioned cutout 3110 on the lower side of the section 311 in the form of a circular disk. The pin 321 in this case engages in an appropriately shaped receptacle 3111 on the lower side of the section 311 in the form of a circular disk and brings about fixing of the closure element 32 on the plastic base part 31 with a clamping fit.

The closure element 32 fills the interspace between mutually opposite webs 312, 313 and with these webs forms a grip for inserting the lamp into a corresponding installation opening of a vehicle headlamp. In order to provide coding for different mutually compatible versions of the same type of vehicle headlamps which can be interchanged in the vehicle headlamp, the closure element 32 preferably consists of a colored plastic, the closure elements 32 for different lamp versions being manufactured from different colored plastics.

A metallic spring ring 33, which is interlocked in the plastic material of the section 311 by means of a plurality of integrally formed claw pairs 331, is arranged on the upper side, which faces the lamp vessel 10, of the section 311 in the form of a circular disk of the plastic base part 31. For this purpose, for example, the upper side of the section 311 is provided with an annular depression, whose side wall has webs, which are each arranged between the claws of a claw pair 311. The spring ring 33 is in the form of an annular disk with a surface running perpendicular to its ring axis. The ring axis of the spring ring 33 is arranged coaxially with respect to the ring axis of the section 311. The outer diameter of the spring ring 33 substantially corresponds to the outer diameter of the section 311 on its upper side. The spring ring 33 has three equidistantly arranged, integrally formed spring tabs 332, 333, 334, which protrude out of the surface or ring plane of the spring ring 33, which is in the form of an annular disk, and exert a spring effect in the direction of the ring axis.

The lamp base 30 in addition has a first metal sleeve 34, which is in the form of a metallic hollow cylinder 34 which is open at its ends and is anchored by means of radiofrequency-induced heating in the plastic material on the upper side of the section 311 in the form of a circular disk of the plastic base part 31. The first metal sleeve 34 is arranged coaxially with respect to the section 311 and the spring ring 33, its outer diameter being smaller than the inner diameter of the spring ring 33. A contact-pressure spring 341, which is in the form of a leaf spring, is fixed on the casing surface of the first metal sleeve 34 on its inner side, protrudes outward through an aperture in the casing surface and exerts a spring effect in the direction of a diameter of the first metal sleeve 34. The casing surface of the first metal sleeve 34 has a plurality of holes 342, into which the softened plastic material of plastic base part 31 enters when the metal sleeve 34 is heated during fusing to the plastic base part 31, with the result that the metal sleeve 34, once the plastic melt has solidified, is anchored in the plastic base part 31.

The lamp base 30 also has a second metal sleeve 35, which is in the form of a metallic hollow cylinder 35 which is open at its ends and which is arranged coaxially with respect to the first metal sleeve 34 and is welded to it. An annular collar 350 with three reference tabs 351, 352, 353 is integrally formed on the lower edge, which faces the first metal sleeve 34, of the second metal sleeve 35. The reference tabs 351, 352, 353 protrude from the casing surface of the second metal sleeve 35 and extend in each case in the direction of a diameter of the second metal sleeve 35. The reference tabs 351, 352, 353 are arranged equidistantly along the circumference of the annular collar 350. Details of the reference tabs 351, 352, 353 are illustrated in FIG. 5 using the example of the reference tab 351. The reference tab 351 has, on its lower side facing away from the lamp vessel 10, a centrally arranged, radially running rib 3510. On both sides of the rib 3510, the reference tab 351 has downwardly curved surface sections 3511, 3512, which are each delimited by the rib 3510 and one of the radially running outer edges. The reference tab 352 has a greater width than the two other reference tabs 351, 353 in order to be able to define an unambiguous installed position of the lamp. The second metal sleeve 35 has an annular section 354 with a reduced inner and outer diameter on its upper edge facing the lamp vessel 10. The second metal sleeve 35, with the annular collar 350 and the three reference tabs 351, 352, 353 is in the form of a deep-drawn part.

The lamp base 30 also includes a fixing ring 36 for holding the sealed end 11 of the lamp vessel 10. The fixing ring 36 is in the form of a hollow cylinder, whose outer diameter is smaller than the inner diameter of the annular section 354 of the second metal sleeve 35. That end of the hollow-cylindrical fixing ring 36 which faces the second metal sleeve 35 is designed to be open. The other end of the hollow-cylindrical fixing ring 36 which faces the lamp vessel 10 is covered by a cover face in the form of a circular disk. An aperture, in which the sealed end 11 of the lamp vessel 10 is anchored with a clamping fit, is located in the cover face. For this purpose, a plurality of spring tabs are arranged along the rim of the above-mentioned aperture, which spring tabs are latched in behind glass webs on the sealed end 11 of the lamp vessel 10 and between which spring tabs the sealed end 11 is fixed with a clamping fit. Such a fixing ring 36 and the anchoring of the sealed end 11 is disclosed, for example, in the patent specification EP 0 775 366 B1. The fixing ring 36 is welded to the lamp vessel 10 anchored therein with the second metal sleeve 35 by means of a laser at a plurality of points. In order to align the incandescent filaments 21, 22 with respect to the three reference tabs 351, 352, 353, the fixing ring 36 including the lamp vessel 10 fixed therein and the incandescent filaments 21, 22 enclosed in the lamp vessel 10 is inserted into the second metal sleeve 35 and displaced in the direction of the cylinder axis of the second metal sleeve 35 and inclined with respect to the abovementioned cylinder axis through a specific angle and rotated until the incandescent filaments 21, 22 have reached the desired position and orientation. Then, the abovementioned laser welding of the fixing ring 36 and the second metal sleeve 35 in the adjusted position is carried out.

In order to fit the halogen incandescent lamp in a vehicle headlamp, the lamp is inserted into the installation opening of the headlamp reflector and, as a type of bayonet closure, is locked in the installation opening by quarter rotation about the longitudinal axis of the lamp. The reference tabs 351, 352, 353 and the spring tabs 332, 333, 334 are used for this purpose. The rim of the installation opening of the reflector after the quarter rotation is arranged with a clamping fit between the reference tabs 351, 352, 353 and the spring tabs 332, 333, 334, with the result that the lamp is fixed in the axial direction. The ribs 3510 of the reference tabs 351, 352, 353 are in this case fitted so as to latch in behind on corresponding webs on the inner side of the reflector in the rim region of the installation opening. The contact lugs 61, 62, 63, by means of the quarter rotation when the bayonet closure is locked, are rotated into the position which is required in order to produce an electrical contact with the corresponding lampholder contacts of the headlamp. The leaf spring 341 bears in clamping fashion against the rim of the installation opening and fixes the lamp laterally, i.e. perpendicular to the lamp's longitudinal axis. The position of the reference tabs 351, 352, 353 also fixes the position and alignment of the incandescent filaments 21, 22 in the reflector of the vehicle headlamp since appropriate cutouts for the reference tabs 351, 352, 353 are provided in the installation opening of the reflector, and these cutouts only permit a single installation position.

The invention is not restricted to the exemplary embodiment described in more detail above. In particular, the cutout 3110, which is arranged on a lower side, which faces away from the lamp vessel 10, of the plastic base part 31, can also be formed, for example, only by the lower side of the section 311 in the form of a circular disk and the webs 312, 313 of the plastic base part 31 and does not need to comprise a depression in the lower side of the section 311 in the form of a circular disk of the plastic base part 31.

The invention claimed is:

1. A lamp base with a plastic base part, which is provided with electrical terminals for supplying power to at least one luminous means of the lamp which is surrounded by a lamp vessel, the electrical terminals being in the form of contact lugs, whose first end protrudes laterally, perpendicular to the longitudinal extent of the lamp base, out of the plastic base part in each case for the purpose of producing the electrical contact with a lampholder, and whose second end is provided in each case for connection to a power supply wire, which is passed out of the lamp vessel, for the at least one luminous means, wherein the plastic base part comprises a disk-shaped section with a lower side facing away from the lamp vessel and two mutually opposite webs which are integrally formed on said lower side of the disk-shaped section and which extend parallel to the axis of said disk-shaped section, the electric terminals are embedded in one of said webs, so that the first ends of the electrical terminals protrude laterally out of said web of the plastic base part and are arranged one above the other in the direction of the longitudinal extent of the lamp base, the second ends of the electrical terminals are arranged in a cutout located at the lower side of the disk-shaped section of the plastic base part, and a closure element covering said cutout is inserted into the interspace between the two webs and is connected via guiderails to the two webs.

2. The lamp base as claimed in claim 1, wherein the second ends of the electrical terminals each have an aperture or a notch for accommodating a power supply wire.

3. The lamp base as claimed in claim 2, the plastic base part further comprising funnel-like leadthroughs, which extend as far as the lower side of the plastic base part and which are positioned above the apertures, and which are provided for the power supply wires.

4. The lamp base as claimed in claim 1, the second ends of the electric terminals being arranged in a common plane perpendicular to the longitudinal extent of the lamp base.

* * * * *